US007160092B2

(12) United States Patent
Stefani

(10) Patent No.: US 7,160,092 B2
(45) Date of Patent: Jan. 9, 2007

(54) STRUCTURE FOR PRESSES, INPARTICULAR FOR FORMING CERAMIC PRODUCTS

(75) Inventor: Franco Stefani, Sassuolo (IT)

(73) Assignee: System S.p.A., Fiorano Modenese (IT)

( * ) Notice: Subject to any disclaimer, the term of this patent is extended or adjusted under 35 U.S.C. 154(b) by 436 days.

(21) Appl. No.: 10/492,933

(22) PCT Filed: Nov. 6, 2001

(86) PCT No.: PCT/EP01/13090

§ 371 (c)(1),
(2), (4) Date: Apr. 19, 2004

(87) PCT Pub. No.: WO03/039846

PCT Pub. Date: May 15, 2003

(65) Prior Publication Data

US 2004/0261489 A1 Dec. 30, 2004

(51) Int. Cl.
*B30B 15/04* (2006.01)
*B28B 3/02* (2006.01)

(52) U.S. Cl. ..... 425/77; 425/408; 425/411; 425/419; 425/450.1

(58) Field of Classification Search ..... 425/77, 425/408, 411–412, 419, 450.1, 451.4
See application file for complete search history.

(56) References Cited

U.S. PATENT DOCUMENTS 3,563,167 A 2/1971 Pennell et al.
3,783,775 A * 1/1974 Von Platen et al. ..... 100/214
4,155,476 A * 5/1979 Lipiec et al. ..... 425/77

FOREIGN PATENT DOCUMENTS

| | | |
|---|---|---|
| DE | 199 49 473 | 10/2000 |
| EP | 0 916 461 | 5/1999 |
| EP | 1 008 438 | 6/2000 |
| EP | 1 118 456 | 7/2001 |

* cited by examiner

*Primary Examiner*—Yogendra N. Gupta
*Assistant Examiner*—Thu Khanh T. Nguyen
(74) *Attorney, Agent, or Firm*—Young & Thompson

(57) ABSTRACT

A structure for presses includes: a resistant structure having at least one resistance element having a flat annular element internally of which and in diametrically opposite positions two facing surfaces are arranged, between which facing surfaces at least one tool can be inserted, for exerting a pressing action and compressing between two bodies, the two facing surfaces receiving equal and opposite reactions to the pressing action. Cuts at ends of the facing surfaces involve a total thickness of the facing surface. Each cut includes a first tract parallel to a pressing direction and a second circular part; the circular second part constituting a snug seating for discs. Interpositioning elements are provided for being interpositioned between ends of the facing surfaces so that two resultants, parallel to the pressing direction, of action exerted on each facing surface are located externally to centers of corresponding circular second parts.

9 Claims, 2 Drawing Sheets

STRUCTURE FOR PRESSES, INPARTICULAR FOR FORMING CERAMIC PRODUCTS

TECHNICAL FIELD

The invention is applicable to the field of presses, in particular for forming ceramic products. The field is very general, and certainly includes all possible applications in which a moulding or plastic deformation (by pressing) is involved, preferably with a vertical application of force. Specifically, though not exclusively, the invention is usefully applied in the field of formation of ceramic manufactures, especially tiles.

BACKGROUND ART

Vertical hydraulic presses for forming ceramic tiles are taught in the prior art, and usually exhibit a structure or frame which connects mobile and fixed parts of the press, which structure has to be very rigid and, in the example, is typically a closed frame with two uprights; access to the work area being afforded by two work benches, fore and aft of the frame.

There is usually a very large free space (indeed, as large as possible) between the two uprights or columns (which define the "mouth" of the press, through which the material to be formed enters). This free space is modelled on the basis of the largest tile format to be used (rectangular), as this is largest flat surface that will have to be modelled in the press through necessarily intermittent and discontinuous operations.

The fact of having a large area for introduction of material, combined with a much smaller depth, is connected with the need to minimise the run of a usual material loading truck, with the aim of penalising the productivity rate as little as possible.

A consequence of this necessarily large opening between the uprights is that the rigid structure of the press develops in a perpendicular plane to the plane of entry of the material to be formed, and is rather massive and tall—so tall in fact that in some cases the press has to be partially interred to give the necessary stability to the structure.

The height of these structures is basically due to the usual constructional technique which includes the use of a base and an upper crossbar, connected by the uprights, which have to be very thick in a vertical direction in order to confer a high degree of undeformability to the two planes bearing the brunt of the reactions following the pressing action. These two planes are those on which the upper and lower parts of the mould operate.

By way of example, in hydraulic presses used for forming ceramic tiles, which presses are liable to exert a pressing force of up to 7,000 tonnes and which have a free space between the uprights of more than 2 meters, the whole structure can be above 7 meters high, and can be buried by up to a third.

In consideration of the forces in play, in order to guarantee these known structures sufficient undeformability so that they can cope with any possible defects in power loading in the moulds, various solutions have been proposed, including constructionally complex ones which are not entirely satisfactory.

The same applicant provided interesting technical solutions, object of EP publications EP 1008438 and EP 1118456. These solutions, while able to resolve the main problems of the prior art as outlined herein above, have a certain constructional complexity, namely the manufacture of a considerable number of parts, and assembly thereof which is neither easy nor smooth.

Further, the coupling of mobile segments 3 on the single arches which modularly assembled form the press, which mobile segments 3 are half-moon shaped and located opposite one another, and between which the hydraulic actuator operates, can represent a drawback from the functional point of view (as well as others) inasmuch a certain degree of maintenance is required.

The main aim of the present invention is to obviate the limitations in the prior art by providing a compact, light and simply-constructed press.

A further aim of the invention is to provide a press structured modularly, with which it is both possible and simple, without changing the inlet "mouth", to vary the maximum pressing force attainable.

An advantage of the invention consists in the fact that it exhibits a structure which, compared in terms of maximum force attainable with other presses, is notably light and small.

A further advantage of the invention is that it is constructionally very simple, in particular as regards the number of separate parts and the assembly techniques of those parts.

A further advantage is that the press is compact, making transport thereof easier as well as installation at destination.

A still further advantage is that the press can be used in a plant for forming ceramic tiles by powder press-forming, in which a continuous line operates which comprises a mobile conveyor plane supporting both the material (powders) to be pressed and the formed material ready for pressing. The conveyor "crosses" a forming device (mould) coupled to the invention itself.

DISCLOSURE OF INVENTION

These aims and advantages and more besides are all attained by the present invention, as it is characterised in the appended claims.

Further characteristics and advantages of the present invention will better emerge from the detailed description that follows of a preferred but non-exclusive embodiment of the invention, illustrated purely by way of a non-limiting example in the accompanying figures of the drawings, in which.

Figure 1:
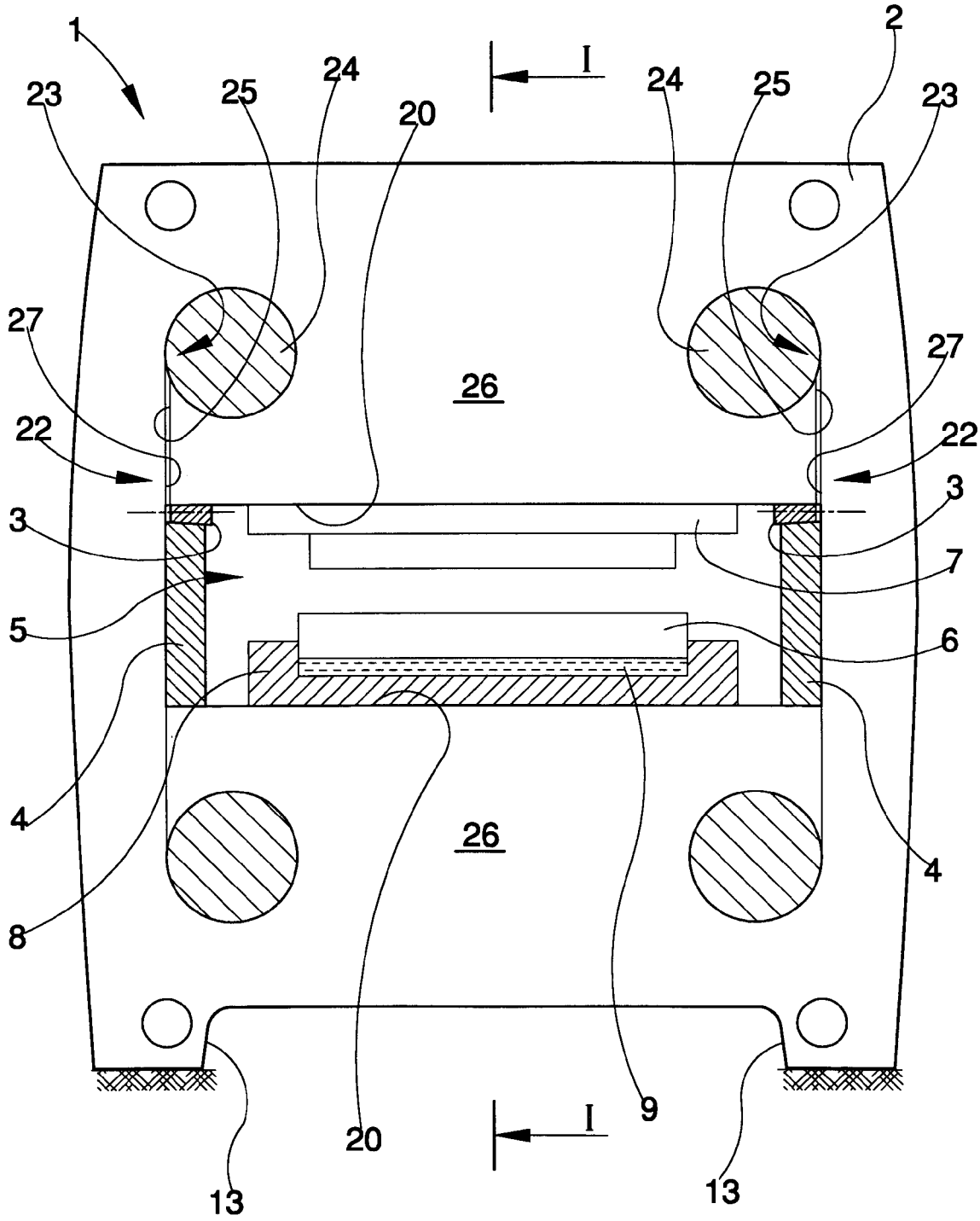
FIG. 1 is a schematic frontal view of the invention, in vertical elevation.
Figure 2:
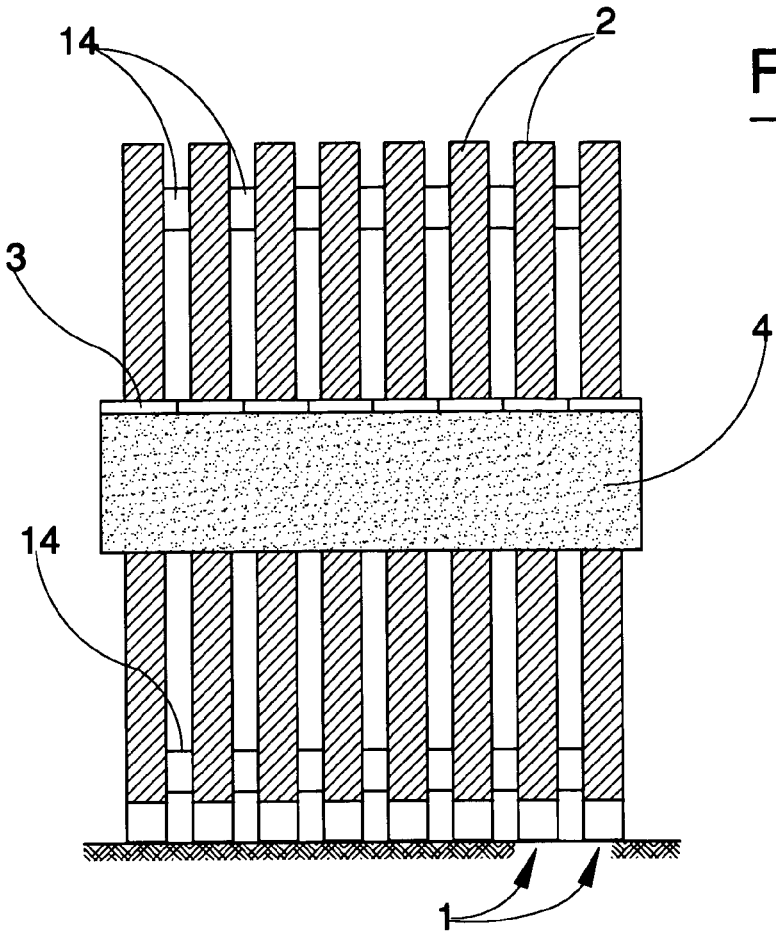
FIG. 2 is a schematic section made according to line I—I of FIG. 1, with some parts removed better to evidence others.
Figure 3:
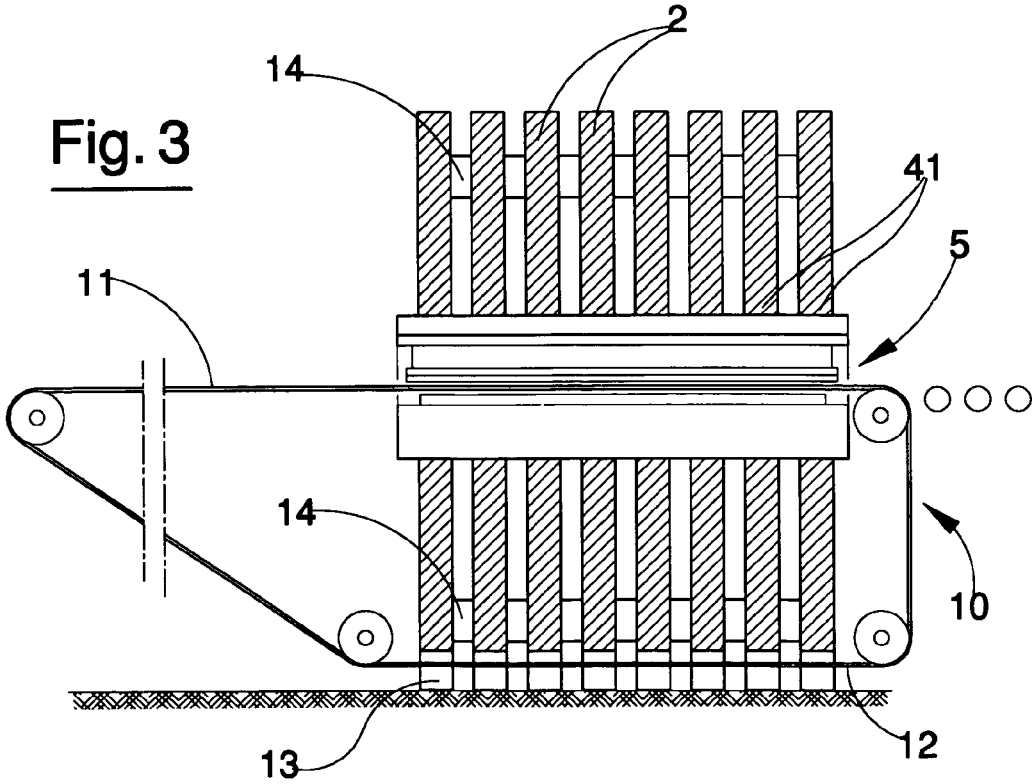
FIG. 3 is the same section as FIG. 2, showing an application of the invention to a plant for forming ceramic manufacture in line, especially tiles.

With reference to the figures of the drawings, 1 denotes in its entirety a resistance element which comprises an annular element 2 internally of which two facing surfaces 20 are located in diametrically opposite positions. At least one power tool 5 can be inserted between the surfaces 20, which exerts the pressing action by compressing the material to be pressed between two bodies, with the equal and opposite reactions to the pressing force being dispersed through the facing surfaces 20.

The annular element 2 is made from a single sheet of steel, appropriately cut. The facing surfaces 20 are cut throughout their thickness at their ends. The cuts comprise a first tract 22, parallel to a pressing direction, and a second part 23, circular in shape or nearly so.

These cuts are symmetrically arranged with respect to the median axis (vertical) of the annular element 2 which is contained in the median plane which is perpendicular to the element 2 and the facing surfaces 20.

The first tracts 22 identify first lateral surfaces 25 which laterally delimit two facing central parts 26 of the annular element 2 bearing the surfaces 20.

Each first tract 22 also identifies a second lateral surface 27 which is close to and opposite the corresponding and facing lateral surface 25 and which connects with the surface delimiting the corresponding circular second part 23.

In particular, each second lateral surface 27 is tangential to the corresponding circular second part 23.

The circular second parts 23 constitute seatings for snugly housing discs 24.

The geometrical arrangement of the surfaces 20, the first tracts 22 and the circular second parts 23 is such that centres of the circular second parts 23, which contribute to delimiting each of the two central parts 26, are located at a distance which is smaller than the distance between the first lateral surfaces 25.

This arrangement has the aim of setting up a predetermined distribution of the loads acting on each single annular element 2, through the use of means for interpositioning at predetermined forces between the two ends of the facing surfaces 20 in proximity of the second surfaces 27, so that the two resultants, parallel to the pressing direction, of the actions exerted on each surface 20 are located externally of the centres of the corresponding circular second parts 23.

The means for interpositioning between the facing surfaces 20 comprise two spacers 4, parallelepiped in shape with preloaded wedges 3 for interacting between the ends so that between the spacers 4 and the remaining parts of the facing surfaces 20 there is a chamber internally of which the power tool 5 is housed.

The preloaded wedges 3 can be pre-loaded independently and very simply by means of tension-rods The overall structure of the press involves assembly of a plurality of the resistance elements 1 arranged side-by-side and aligned consecutively at a predetermined distance one from another which is obtained by means of special spacers.

The resistance elements 1 and in particular the annular elements 2 are assemblable with an arrangement and modular organisation by virtue of which the variation in the number of assembled resistance elements 1 enables a proportionate variation of the maximum allowable pressing force.

Distancing the annular elements 2 can be done using spacers 14 located between the facing surfaces of any two consecutive annular elements 2.

The pressing action is exerted by the power tool 5 which operates between the facing surfaces 20. This tool 5, in the illustrated embodiment, is constituted by a lower body 6 and an upper body 7, between which objects or the material to be pressed can be inserted, and by a hydraulic actuator, comprising, on a base 8, a chamber 9, into which fluid is sent under pressure; the chamber 9 being superiorly sealedly closed by the lower body 6, which is a piston.

The base 8 and the upper body 7 rest contactingly on the facing surfaces 20 on the resistance elements 1 which are reciprocally assembled arranged facing and consecutively aligned at a predetermined reciprocal distance.

The pressing action is realised by sending pressurised fluid into the chamber 9 and can be operated on powdery material predisposed on the upper branch 11 of a ring-wound conveyor belt 10. The upper branch 11 longitudinally crosses the whole press and exhibits: a part which is upstream of the press, which is the support on which the powder loads are prepared, the loads being destined to be press-formed; and a part which is downstream of the press, on which the formed tiles are removed. The central part of the belt, comprised between the upstream and downstream parts, is comprised between the lower body 6 and the upper body 7 of the press, against which parts the powder is compressed and formed during the pressing operation; the upper branch of the belt is in fact the bottom die of the mould.

The belt returns through its lower branch 12, freely running below the body of the press between the feet 13 exhibited by each of the resistance elements 1, which feet 13 are made in a single piece with the corresponding annular elements 2.

The structure of the press according to the invention is free of bolts and welded parts.

Assembling the press of the invention is very simple, as is preloading the structure. The wedges 3 are easily moved externalwise by means of simple tension-rods.

Preloading has a double function: it keeps the machine together and makes the structure absolutely rigid during the first pressing stage, up until when the total press-force overtakes the preload value. This is obtainable with very simple adjustments and is particularly important in powder pressing for tile-forming because it allows for variation in powder behavior during pressing (prevalently plastic during the initial stage, prevalently elastic during the final stage).

The particular geometry of the cuts in the annular elements 2 enables greater exploitation of the material, considerably reducing the risk of concentration of tensions.

The structure provides, at comparable pressing forces, a much lighter overall encumbrance (4–5 times lighter) than a traditional press.

The constructional simplicity, especially with regard to assembly, requiring no welding nor bolts, reduces costs considerably.

The modular construction, while not affecting the size of the "mouth" of the press, enables, for example, maximum pressing force to be increased, simply by adding resistance elements 1. This means, for example, that production capacity can be increased at each pressing cycle.

The total load the whole structure is capable of bearing is given by the sum of the loads which each resistance element 1 can bear.

Also, the smaller dimensions mean that transport is easier, as is location and installation at destination.

The invention claimed is:

1. A structure for presses, in particular for forming ceramic products, comprising: a resistant structure constituted by at least one resistance element (1) which in turn comprises a flat annular element (2) internally of which and in diametrically opposite positions two facing surfaces (20) are arranged, between which facing surfaces (20) at least one power tool (5) can be inserted, for exerting a pressing action and compressing between two bodies an object or a material to be pressed; the two facing surfaces (20) receiving equal and opposite reactions to forces developing during the pressing action; cuts being made at ends of the facing surfaces (20) which cuts involve a total thickness of the facing surfaces (20); each of the cuts comprising a first tract (22) which is parallel to a pressing direction and a second part (23) which is circular in shape; the cuts being arranged symmetrically with respect to a median axis of the annular element (2) which median axis is perpendicular to the annular element and the facing surfaces (20); the first tracts (22) of cut identifying first lateral surfaces (25) which laterally delimit two opposite central portions (26) of the annular element (2) bearing the surfaces (20); the circular second part (23) of cut constituting a snug seating for discs (24) and a centre of each central part (26) being located at a distance which is smaller than a distance between the first lateral surfaces (25); means for interpositioning being provided for being interpositioned between ends of the facing surfaces (20) so that two resultants, parallel to the pressing direction, of action exerted on each of the facing surfaces (20) are located externally to centres of corresponding circular second parts (23).

2. The structure for presses of claim 1, wherein each of the first tracts (22) identifies a second lateral surface (27) which is opposite the first lateral surface (25) and which connects with the surface delimiting the circular second part (23).

3. The structure for presses of claim 2, wherein each second lateral surface (27) is tangential to a corresponding circular second part (23).

4. The structure for presses of claim 3, comprising a plurality of the resistance elements (1) arranged facing one another and aligned consecutively at a predetermined distance one from another.

5. The structure for presses of claim 4, wherein the plurality of resistance elements (1) is assemblable in a modular arrangement and organisation by virtue of which a variation of a number of assembled resistance elements (1) enables a proportional change in a maximum pressure force that can be exerted.

6. The structure for presses of claim 5, wherein the means for interpositioning at a predetermined force between ends of the facing surfaces (20) comprise two parallelepiped spacers (4) collaborating with wedges (3) for interacting between the ends in such a way that a chamber is identified between the spacers (4) and a remaining portion of the facing surfaces (20), internally of which chamber the power tool (5) is housed.

7. The structure for presses of claim 6, wherein the wedges (3) can be acted upon independently of one another using tension-rods, up until a predetermined preload is obtained.

8. The structure for presses of claim 6, wherein the power tool (5) comprises a lower body (6) and an upper body (7) between which material to be pressed can be inserted; a hydraulic actuator being provided, comprising, on a base (8) thereof, a chamber (9) into which pressurised fluid is sent; the chamber (9) being superiorly closed by the lower body (6) which functions as a piston; the base (8) and the upper body (7) resting on the facing surfaces (20) on the resistance elements (1) assembled facing one another and aligned consecutively at a predetermined reciprocal distance.

9. The structure for presses of claim 7, wherein the power tool (5) comprises a lower body (6) and an upper body (7) between which material to be pressed can be inserted; a hydraulic actuator being provided, comprising, on a base (8) thereof, a chamber (9) into which pressurised fluid is sent; the chamber (9) being superiorly closed by the lower body (6) which functions as a piston; the base (8) and the upper body (7) resting on the facing surfaces (20) on the resistance elements (1) assembled facing one another and aligned consecutively at a predetermined reciprocal distance.

* * * * *